United States Patent [19]

Pascale et al.

[11] 4,111,124

[45] Sep. 5, 1978

[54] METHOD AND APPARATUS FOR PRODUCING FACTORY-TRIMMED WALL COVERING

[76] Inventors: Frank R. Pascale, 40 Park Way, Sea Cliff, N.Y. 11579; Ralph I. Preuss, 19 Wellsley Rd., Rockville Centre, N.Y. 11570

[21] Appl. No.: 779,265

[22] Filed: Mar. 18, 1977

[51] Int. Cl.[2] ..... B41M 1/12; B26D 5/08

[52] U.S. Cl. ..... 101/426; 101/129; 101/DIG. 19; 83/14; 83/56; 83/614; 83/824; 83/923

[58] Field of Search ..... 101/DIG. 19, 126, 129, 101/426; 83/562, 565, 614, 642, 455, 824, 825, 56, 13, 14, 22, 923, 3

[56] References Cited

U.S. PATENT DOCUMENTS

| | | | |
|---|---|---|---|
| 312,043 | 2/1885 | Van Horn | 83/565 X |
| 621,299 | 3/1899 | Empfield | 83/455 |
| 821,681 | 5/1906 | Vandermark | 83/565 X |
| 908,499 | 1/1909 | Ridgely | 83/614 X |
| 1,053,359 | 2/1913 | Clark | 83/614 X |
| 1,379,597 | 5/1921 | Trogner | 83/56 X |
| 1,551,917 | 9/1925 | Waldheim | 197/126 A |
| 2,065,380 | 12/1936 | Lamson | 83/614 X |
| 2,164,603 | 7/1939 | Wheelwright | 101/126 X |
| 2,409,203 | 10/1946 | Gale | 83/614 X |
| 2,747,664 | 5/1956 | Corson | 83/614 X |
| 3,513,744 | 5/1970 | Hershberger | 83/614 X |
| 3,805,699 | 4/1974 | Mallofre | 101/126 X |

*Primary Examiner*—Clifford D. Crowder
*Attorney, Agent, or Firm*—Leonard H. King

[57] ABSTRACT

The method hereof, conducted at the factory or site of printing of the wall covering, advantageously uses the same work or printing station reference that accurately positions the imprinted pattern on the wall covering substrate for the positioning of cutting means effective to sever said substrate free of the opposite unprinted selvage areas. Thus, although the substrate, which typically is a 100-foot strip, may be inadvertently slightly misaligned from a perfectly straight orientation, the cutting means nevertheless effectively moves along that path which accurately slits free the selvages of the "misaligned" substrate because it is guided by said imprinting reference during said movement.

4 Claims, 4 Drawing Figures

METHOD AND APPARATUS FOR PRODUCING FACTORY-TRIMMED WALL COVERING

The present invention relates generally to improvements for wall covering, of paper, vinyl or other appropriate substrate material, and more particularly to an effective factory method and apparatus for producing trimmed, ready-to-use wall covering.

As an alternative to hand trimming the opposite selvage areas of wall covering in the bolt at its point of use, efforts have been made to use shear or roll slitting devices to remove these selvages at the factory or site of manufacture. These prior art devices invariably operate by cutting inwardly of the bolt edge, and thus use said edge as the positioning reference for the cutting or shearing implement. In practice, however, the width of the selvage is seldom uniform, and thus at any selected cutting or shearing location, there is apt to be some selvage that is not totally removed or, the reverse, wherein some of the imprinted pattern or design is removed.

Broadly, it is an object of the present invention to provide an improved factory method and apparatus for trimming wall covering precisely along the lines extending along its opposite sides that delineate the imprinted pattern thereon and said selvages, thereby overcoming the foregoing and other shortcomings of the prior art. Specifically, it is an object to use for the selvage-cutting or severing implements the same positioning reference as is used for the positioning of the imprinted pattern or design thereon; thus, to the extent that the line delineating the design from the selvage is part of that which is accurately, and thus uniformly, positioned from said reference, the same is effective in guiding severing means along said selvage-delineating line, and thus properly trimming said wall covering of its selvage.

As understood, the imprinting of wall covering contemplates the use of equipment including an elongated wall covering support surface having a position-establishing reference edge oriented lengthwise of said support surface adjacent one edge thereof, and a factory method, demonstrating objects and advantages of the present invention, using said equipment for producing an elongated strip of printed wall covering without unprinted selvage areas along opposite edges thereof includes an initial step of arranging a blank strip of wall covering in fixed position on said support surface in aligned relation to said reference edge. Occurring next is the successive imprinting of length segments of the wall covering strip with a design having design-delineating lines on opposite side edges thereof delineating the printed design located in a medial area on said wall covering from unprinted selvage areas located along the opposite peripheral side edges of said wall covering strip. Underlying the present invention is the recognition that said successive imprints of said wall covering design are accurately positioned on said wall covering strip using said reference edge and that this correspondingly positions each said opposite edge design-delineating line a prescribed uniform distance from said reference edge. The within method thus contemplates that while said printed wall covering strip is in said fixed position on said support surface that the final step consist of severing free said opposite unprinted selvage areas along said design-delineating lines thereof by using said reference edge to position a means effective to sever said wall covering in aligned cutting relation to said design-delineating lines. In this manner, the resulting printed wall covering is effectively trimmed preparatory to use.

The above brief description, as well as further objects, features and advantages of the present invention will be more fully appreciated by reference to the following detailed description of a presently preferred, but nonetheless illustrative embodiment in accordance with the present invention, when taken in conjunction with the accompanying drawings, wherein.

The method and apparatus of the present invention has as its commercial object the production of wall covering, either of a paper, vinyl or other appropriate construction material substrate, which at the conclusion of the process used in the factory for its manufacture is devoid of any unprinted selvage areas. As such, the wall covering, or more particularly supply rolls in which it is typically sold to the consumer, does not have to be trimmed by the party hanging the wall covering.

TYPICAL FACTORY PROCEDURE FOR MANUFACTURE OF WALL COVERING

Figure 1:
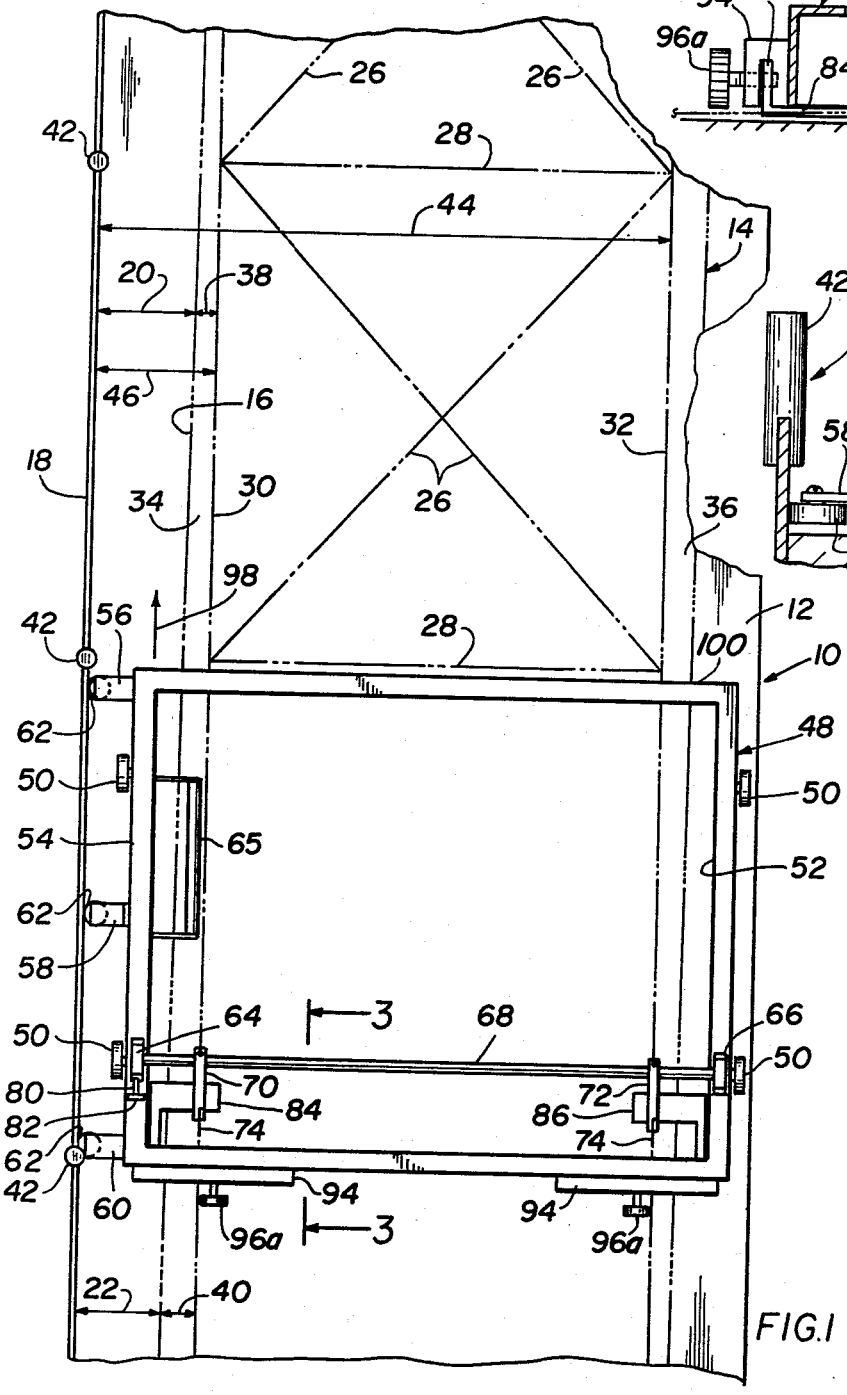
FIG. 1 is a partial plan view of an apparatus for producing factory-trimmed wall covering according to the present invention, the mode of operation of which apparatus also demonstrating an effective method for producing this desirable product.

As helpful background to an understanding of the present invention, reference is made to FIG. 1 and the showing therein of a table generally designated 10 having a work surface or top 12 appropriately sized to receive thereon a 90-foot length of blank or virgin wall covering, generally designated 14. Wall covering 14, in strip form, is attached to one end of the work surface 12, in any appropriate way, and then unrolled lengthwise of the table 10. During the unrolling, some effort is made to provide a perfectly straight orientation to the strip 14, but as a practical matter, for any one of several reasons, this is usually not achieved, even though guidelines and other such aids are resorted to. It is perhaps suffice to note that the problems in handling a 90-foot length substrate invariably leads to some misalignment from a perfectly straight orientation. This misalignment, illustrated in somewhat exaggerated form in FIG. 1, manifests itself by the lefthand edge 16 of strip 14 being located a non-uniform distance from a side rail 18 of the table 10, the significance and function of which side rail, incidentally, will soon be explained. That is, edge 16 at one point in its fixed position on the surface 12 may be located a distance 20 from rail 18, whereas at another point it may be located a different distance 22 from this rail. In this regard, there is no importance in the fact that distance 22 is illustrated to be less than distance 20; the important fact is that these distances are different, and therefore not uniform.

Figure 2:
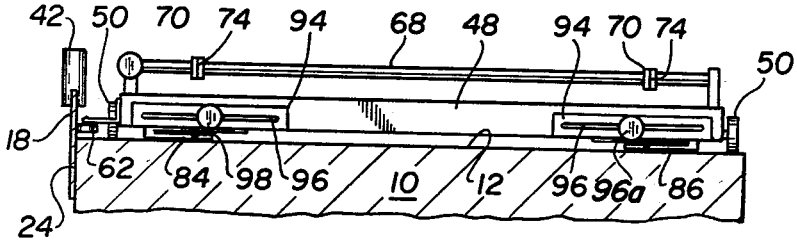
FIG. 2 is a front elevational view projected from FIG. 1 showing further structural details.

As may be readily appreciated by a consideration of FIG. 2 in conjunction with FIG. 1, the just noted rail 18 is an attachment to the table 10 which is provided along the length thereof and adjacent one side, any appropriate means being utilized to attach rail 18 to and along the side 24 of table 10. As generally understood, rail 18 effectively serves as a reference surface or edge in the positioning of the pattern or design that is silkscreened onto successive length segments of the bolt or strip 14. Typically, each repeat of the pattern or design occurs every 26 inches, the same being represented in FIG. 1 by the criss-crossing dot-dash reference lines 26. Also typically, every other length segment is printed, leaving gaps, so that one imprint does not interfere with an adjacent imprint. After an appropriate drying time, however, the gaps are, of course, also filled in or imprinted. The reference line 28 represents the line at which leading and trailing edges of adjacent imprints merge, hopefully without any perceptible separation or tell-tale indication of any discontinuity in the pattern or design.

Each imprinted design 26 bounded, as just noted, by transverse lines 28, is also bounded, in the machine direction, by design-delineating lines 30 and 32. On the outboard side of each of the lines 30 and 32 there are peripheral unprinted selvage areas or strips 34 and 36, and it is these selvage strips 34, 36 which are advantageously factory-trimmed, so as to obviate any subsequent wall covering trimming procedures.

PRIOR ART TRIMMING TECHNIQUES

Heretofore, efforts to trim wall covering contemplated use of shear or roll slitting devices. Such devices, however, operate by cutting inwardly of the bolt edge and thus use said edge as the positioning reference for the cutting implement. The obvious shortcomings of such a procedure will be evident from FIG. 1. More particularly, and taking lefthand edge 16 as an example, since this edge, due to unavoidable misalignment, is located at varying distances 20 and 22 from the positioning rail 18, it necessarily follows that the width of the selvage 34 occurring along edge 16 is also non-uniform. That is, selvage width 38 is unavoidably different from selvage width 40. Thus, in the prior art cutting technique using edge 16 as a reference wherein the cutter is spaced inwardly of said edge, this technique cannot be successful since the cutter cannot cut at one and the same time at both the distances 38 and 40.

Underlying the present invention is the recognition, however, that although distances 20 and 22 differ from each other, as do also the distances 38 and 40, that the total distance as represented by distances 20 and 38, and that represented by distances 22 and 40 are, in fact, the same, or of a uniform extent throughout the entire 90-foot length of the wall covering strip or bolt 14. This necessarily follows since it is the rail 18 which is used as the reference or guide for the location of the silkscreen used in the imprinting of the strip 14. In this connection, and as is well understood, each silkscreen is of a generally rectangular shape and is positioned relative to the wall covering strip by being placed against the rail 18, one edge of the silkscreen frame being aligned with a cooperating guide marking 42, which is one of several such markings provided at the previously referred to typically 26 inch spaced intervals along the length of the table 10, which establish the repeat distances for the pattern. Thus, since rail 18 is used in the positioning of the silkscreen prior to applying the imprint 26 to the substrate 14, it necessarily follows that the design-delineating line 30 will have the same orientation as exists for the rail 18, an orientation which is perfectly straight, even though this is not true of the paper substrate 14. Similarly, the opposite design-delineating line 32 will also occur at a uniform distance 44 from the rail 18 throughout the length of the strip 14, even though there may be some misalignment from a theoretically perfectly straight orientation of the strip 14.

THE INVENTIVE METHOD OF FACTORY-TRIMMING THE WALL COVERING AND PREFERRED APPARATUS FOR PRACTING SAME

In accordance with the present invention it is contemplated that trimming of the strip 14 of its opposite selvage areas 34 and 36 will occur while the strip 14 is still in its fixed position on the work surface 12. As already noted, in this fixed position of the strip 14, the righthand design-delineating line 32 is located a uniform distance 44 from the rail 18 while the lefthand line 30 is similarly located a uniform distance equal to the total of the distances 20 and 38, and/or 22 and 40, said uniform distance, for convenience, being designated 46 in FIG. 1. The factory-trimming method hereof therefore contemplates using an appropriate knife or cutting edge which is effective to sever the wall covering strip 14 along the lines 30 and 32. This, of course, contemplates aligning a pair of cutting implements with the lines 30 and 32, this alignment, in turn, requiring the location of one cutting implement a distance 46 from the rail 18 and the other cutting implement a distance 44, also from the rail 18. Thus, the rail 18 functions effectively as a common reference from which appropriate cutting or wall covering-severing implements are positioned so as to assume a cutting position in precise alignment with the lines 30 and 32, along which it is necessary to sever or cut the strip 14 in order to free it of its selvage areas 34 and 36. The actual severing operation, as contemplated by the within inventive method hereof, is one which calls for the severing or cutting implement to be moved from a clearance position above each of the lines 30 and 32 through a descending path piercing through the wall covering strip 14 on the lines 30 and 32 at locations at the beginning of the wall covering strip. Following this initial piercing or cutting, it is contemplated that the severing means will then be moved along the length of the surface 12, this movement being effective to cause a slitting of the strip 14 along the lines 30 and 32, thus freeing the strip 14 of the opposite selvage areas or strips 34 and 36. In order to maintain the cutting or slitting means precisely on the lines 30 and 32 during the aforesaid lengthwise movement, rail 18 is, of course, used to great advantage. That is, and as will be subsequently explained, the severing or cutting means are mounted on a carriage movable along the surface 12 and the rail 18 is effectively used as a guide for this carriage movement, and thus maintains the cutting edges precisely on the lines 30 and 32 by respectively maintaining the two cutting implements at the noted uniform distances 46 and 44, respectively, from the rail 18.

A preferred apparatus for practicing the method of trimming the wall covering 14 at the factory in the manner just described will now be described, but it will of course be understood that the invention is not to be limited to such apparatus since many structural changes can be made thereto while still practicing said method. The previously referred to carriage of said apparatus may consist simply of a rectangular frame 48 having wheels, individually and collectively designated 50, appropriately journalled for rotation in depending relation on opposite sides of the frame 48. In this manner, the frame or carriage 48 is movable lengthwise along the surface 12 with its rectangular opening 52 strategically located above the strip 14 and thus providing access to this strip for cutting or slitting purposes.

To facilitate use of the rail 18 as a guide during lengthwise movement of the carriage 48, the lefthand side 54 of the carriage has three strategically spaced brackets 56, 58 and 60 extending laterally therefrom, on each of which there is appropriately journalled for rotation a horizontally oriented roller or wheel, individually and collectively designated 62. The rollers 62 are maintained in rolling contact against the rail 18 which, of course, effectively maintains the carriage 14 along a guided path lengthwise of the surface or table 12. To facilitate movement of carriage 48 lengthwise of table 12 while maintaining the rollers 62 against the rail 18, the user is provided with a gripping handle 65 appropriately mounted on side 54 within the frame opening 52 by which he can effectively urge the carriage 48 through lengthwise movement while simultaneously exerting enough side pressure towards the rail 18 to maintain the rollers 62 against the rail 18.

Figure 3:
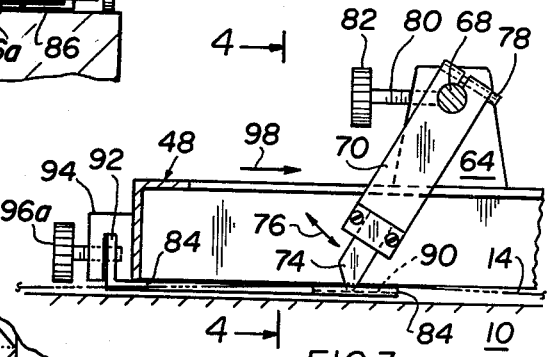
FIG. 3 is a partial side elevational view, taken along lines 3—3 of FIG. 1, illustrating the details of the cutting and selvage-trimming implement of the within apparatus.

Adjacent the rear of the frame opening 52, the frame has two upstanding supports 64 and 66 between which there is mounted in spanning relation a cylindrical rod 68, rod 68 serving as a guide for sliding movement in opposite directions therealong of two cutting edge holders 70 and 72, each appropriately pivotally mounted thereon, as is perhaps best illustrated in FIG. 3. Each holder is provided with a razor or cutting edge 74 which, when the holder is moved from a clearance position above the wall covering strip 14 through a pivotal traverse 76, pierces or cuts through the wall covering at the place of contact therewith. This point of contact, of course, is selected to be at the beginning of the wallpaper strip 14 and on direct alignment with one of the lines 30 and 32. To achieve this alignment, each of the holders 70 and 72 is moved along rod 68 until this condition is achieved, and then each is pivoted to pierce the wall covering and set in place by tightening a clamping screw 78. Set screw 80 with a turning knob 82 is then advantageously used to hold the cutting edge 74 in slitting relation to the pierced wall covering 14.

Figure 4:
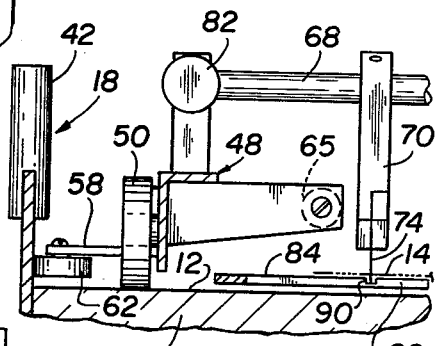
FIG. 4, like FIG. 2, is a front elevational view, but of a partial nature and as seen taken along line 4—4 of FIG. 3, showing further structural details of said selvage-trimming implement of the within apparatus.

Typically, work surface 12 is covered with sailcloth or other such construction material and it is of course desirable that this covering be protected against damage during the slitting of the wall covering strip 14. Accordingly, the cutting or slitting mechanism contemplates use of a platform having an operative interposed position between the strip 14 and table 12 which is effective in lifting and holding strip 14 off of the surface 12 during this slitting operation. Preferably, each cutting edge or razor 74 has a cooperating platform, as just referred to, the same being designated 84 and 86, and each being generally L-shaped and mounted in any appropriate manner on the carriage 48 so that one leg of the L-shape can advantageously be extended inwardly of each peripheral edge of the strip 14. As best illustrated in FIG. 4, the foregoing is exemplified by the showing of leg 88 of platform 84 extending under the wall covering 14 and having a recess 90 to accommodate the cutting edge 74.

As is perhaps best illustrated in FIG. 3, platform 84 has a rear upturned wall 92 which is projected into a cooperating recess of a mounting bracket 94 appropriately attached to the rear wall of the carriage 48. As best shown in FIG. 2, bracket 94 has a slot 96 which allows for whatever lateral adjustments are necessary in the positioning of the platform 84 in order to align the cutting edge 74 with the recess 90 thereof. Once this alignment is achieved, the position of the platform 84 is fixed in any appropriate manner, such as by threaded manipulation of the set screw means **96*a*. It will of course be understood that similar mounting structure is provided for the other L-shaped platform 86, and that for simplicity sake a description thereof has not been provided as being unnecessary. For completeness sake, however, the same structural features are designated by the same reference numerals as used in connection with the L-shaped member 84**.

During lengthwise movement 98 of carriage 48 during which, as already described, the wall covering strip 14 is effectively stripped of its opposite peripheral selvage areas 34 and 36 precisely along the lines 30 and 32, it may be necessary to successively remove means adhering the strip 14 to the table top 12. This means may consist of masking tape or, more typically, it may consist of spaced apart staples applied along the edges of the strip 14. In either case, the operator simply moves the carriage 48 along the strip 14 until the frame edge 100 is within approximately one inch of the strip-holding piece of tape or staple. After removal of the tape or staple, the movement of the carriage is continued until the next encountered strip-holding means which, of course, is also removed. In this manner, strip 14 is effectively freed of its unprinted selvage areas 34 and 36 precisely along the design-delineating side lines 30 and 32, with the result that the 100-foot length thereof is totally devoid of any unprinted peripheral areas which would require trimming preparatory to use of the wall covering. The 100-foot strip 14 is then typically made into six rolls of wall covering which are of significantly enhanced commercial value because they do not require any trimming preparatory to use.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

In the foregoing specification reference has been made to unprinted selvage areas. Actually the "unprinted" selvage areas normally have printed thereon the manufacturer's identification, trademark and copyright data, color sequence information and trimming markings. The paper is normally trimmed along an invisible line between marks such as tips of arrowheads perpendicular to the paper edge or brief lines parallel to the paper edge. Leading and trailing edges of adjacent imprints rarely meet in a straight line. The successive patterns typically interdigitate.

What is claimed is:

1. A method of producing an elongated strip of printed wall covering without unprinted selvage areas along opposite edges thereof using an elongated wall covering support surface having a position-establishing reference edge oriented lengthwise of said support surface adjacent one edge thereof, said method comprising the steps of arranging a blank strip of wall covering in fixed position on said support surface in aligned relation to said reference edge, successively printing length segments of said wall covering strip with a design having design-delineating lines on opposite side edges thereof delineating the printed design located in a medial area on said wall covering from unprinted selvage areas located along the opposite peripheral side edges of said wall covering strip, said successive imprints of said wall covering design being positioned on said wall covering strip using said reference edge to correspondingly position each said opposite edge design-delineating line a prescribed uniform distance from said reference edge, and while said printed wall covering strip is in said fixed position on said support surface severing free said opposite unprinted selvage areas along said design-delineating lines thereof by using said reference edge to position a means effective to sever said wall covering in aligned cutting relation to said design-delineating lines, whereby the resulting printed wall covering is effectively trimmed preparatory to use.

2. The method of producing a trimmed wall covering strip as claimed in claim 1 wherein a substantially continuous cutting stroke along a movement path using said reference edge as a guide is effective in causing said severing of each said selvage area.

3. The method of producing a trimmed wall covering strip as claimed in claim 2 wherein said reference edge is formed as a rail, and said means for severing said wall covering includes a roller for establishing rolling contact along said rail, to thereby facilitate the severing of said wall covering in said substantially continuous cutting stroke.

4. The method of producing a trimmed wall covering strip as claimed in claim 3 wherein said wall covering is horizontally oriented in said fixed position on said support surface, and said severing thereof is achieved using a pivotally mounted cutting edge movable from a clearance position through a descending path initially cutting through said wall covering, said cutting edge thereafter being urged through said continuous cutting stroke lengthwise of said wall covering along a path fixed in its relation to said reference edge, to thereby cause the complete severing separation of each said selvage area from an opposite side of said wall covering.

* * * * *